US007469565B2

(12) United States Patent
Nakaike et al.

(10) Patent No.: US 7,469,565 B2
(45) Date of Patent: Dec. 30, 2008

(54) MANUFACTURING METHOD AND CLEANING EQUIPMENT FOR SEAMLESS TUBE

(75) Inventors: Kouji Nakaike, Wakayama (JP); Yasuyoshi Hidaka, Kobe (JP); Sumio Iida, Takarazuka (JP); Hiroki Kusuda, Osaka (JP); Masami Sakiyama, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/892,327

(22) Filed: Aug. 22, 2007

(65) Prior Publication Data

US 2008/0083254 A1 Apr. 10, 2008

Related U.S. Application Data

(63) Continuation of application No. PCT/JP2006/303126, filed on Feb. 22, 2006.

(30) Foreign Application Priority Data

Feb. 22, 2005 (JP) ..... 2005-045181

(51) Int. Cl.
*B21B 19/04* (2006.01)

(52) U.S. Cl. ..... 72/97; 72/209; 72/236; 72/251

(58) Field of Classification Search ..... 72/39, 72/40, 41, 97, 250, 251, 208, 209, 236; 198/496
See application file for complete search history.

(56) References Cited

U.S. PATENT DOCUMENTS 3,139,975 A * 7/1964 Schaefer ..... 198/496
3,577,754 A * 5/1971 Calmes ..... 72/45
4,201,070 A * 5/1980 Seaton et al. ..... 72/42
4,678,075 A * 7/1987 Bowman, Jr. ..... 198/496
4,991,419 A * 2/1991 Kuroda et al. ..... 72/97
6,112,427 A * 9/2000 Plociennik et al. ..... 34/66

FOREIGN PATENT DOCUMENTS

| | | | |
|---|---|---|---|
| JP | 64-16894 | | 1/1989 |
| JP | 8-224611 | * | 9/1996 |
| JP | 10-52322 | | 2/1998 |
| JP | 2000-24706 | | 1/2000 |
| JP | 2002-28705 | * | 1/2002 |
| JP | 2004-34072 | * | 2/2004 |
| SU | 333990 | * | 3/1972 |

* cited by examiner

*Primary Examiner*—Edward Tolan
(74) *Attorney, Agent, or Firm*—Clark & Brody

(57) ABSTRACT

A seamless tube is manufactured while effectively suppressing the occurrence of carburization in the seamless tube without interfering with operations.

A seamless tube is manufactured by a step of washing at least a portion of a conveyor installed in a conveying step of a mandrel bar B which is situated from a lubricant applying device 7 to the entrance of a mandrel mill 8, a step of washing, on the upstream side of the lubricant applying device 7, a mandrel bar B which was used for elongation rolling, and a step of applying a non-graphite-based lubricant to the mandrel bar B with the lubricant applying device 7, wherein the conveyor and the mandrel bar B are each washed such that the amount of graphite C2 ($g/m^2$) adhering to the surface of the mandrel bar B before it is provided to elongation rolling and the amount of carbon C1 ($g/m^2$) contained in the organic binder of the applied lubricant satisfy Equation 1: $0.08 \times C1 + 0.05 \times C2 \leqq 3$ and Equation 2: $3 \leqq C1 + C2 \leqq 50$.

4 Claims, 4 Drawing Sheets

(a)

(b)

MANUFACTURING METHOD AND CLEANING EQUIPMENT FOR SEAMLESS TUBE

This application is a continuation of International Patent Application No. PCT/JP2006/303126 filed Feb. 22, 2006. This PCT application was not in English as published under PCT Article 21(2).

TECHNICAL FIELD

This invention relates to a manufacturing method and cleaning equipment for a seamless tube. Specifically, it relates to a manufacturing method and cleaning equipment for a seamless tube which can effectively suppress carburization which occurs on the inner surface of a tube which is being rolled for elongation without obstructing the rolling operation.

BACKGROUND ART

In the manufacture of seamless tube by the Mannesmann mandrel mill method, first, a round billet or a square billet is heated to 1200-1260° C. in a heating furnace, and it is then subjected to piercing by a piercer to produce a hollow shell. Subsequently, a mandrel bar is inserted into the bore of the hollow shell, and the hollow shell is subjected to rolling for elongation in a mandrel mill so as to reduce the wall thickness to a predetermined thickness, thereby forming a tube. The mandrel bar is then withdrawn from the tube having the reduced wall thickness, and the tube is subjected to rolling for sizing in a sizer so as to obtain a desired outer diameter, resulting in the manufacture of a seamless tube as a product.

During elongation rolling, galling (seizure) between a mandrel bar and a hollow shell easily occurs. Therefore, a lubricant is applied to the surface of the mandrel bar. A lubricant which has been most commonly used is a graphite-based lubricant containing graphite which has excellent wear resistance and anti-galling properties. Ideally, after a lubricant applied to the surface of a mandrel bar has dried, the mandrel bar is transported to a mandrel mill while it is in contact with a conveyor such as transport rolls, and it is used for elongation rolling. However, in an actual manufacturing operation, it is often not possible to keep enough time for the applied lubricant to completely dry. Therefore, the lubricant which has not dried drips off during transport of the mandrel bar and adheres to a part of the conveyor beneath the mandrel bar. Even when transport is carried out after the lubricant has completely dried, the film of the applied lubricant drops off or peels off due to vibrations or the like during transport and it adheres to the conveyor. Therefore, a conveyor for a mandrel bar is always contaminated by graphite which is contained in the lubricant deposited thereon. Since a conveyor for a mandrel bar is contaminated by graphite in this manner, a mandrel bar which is transported by the conveyer in contact therewith is also contaminated by graphite.

When a mandrel bar which has been contaminated by graphite in this manner is used for elongation rolling of a hollow shell made of a low carbon steel such as SUS 304L having a carbon content of at most 0.04% (in this description, unless otherwise specified, % means mass %), the inner surface of the tube produced by elongation rolling is unavoidably carburized.

Conceivable countermeasures for preventing this carburization include not using a graphite-based lubricant for elongation rolling of a hollow shell with any type of steel, providing additional processing equipment for elongation rolling in which only a non-graphite-based lubricant is used, or thoroughly washing a conveyor for a mandrel bar when manufacturing a seamless tube of a low carbon stainless steel by elongation rolling in processing equipment in which a graphite-based lubricant has been used.

However, a non-graphite-based lubricant is generally more expensive than a graphite-based lubricant, and provision of new processing equipment requires additional capital investment, so these measures are difficult to carry out from the standpoint of economy. Therefore, the primary countermeasure has been to wash a conveyor for a mandrel bar.

For example, Patent Document 1 discloses an invention using a non-water resistant graphite-based lubricant for improving the washability of a conveyor. Patent Document 2 discloses an invention in which a mandrel bar and a mandrel bar conveyor are washed by spraying with high pressure steam or water such that the amount of adhesion of graphite to the surface of a mandrel bar is controlled to at most 100 $mg/m^2$.

Patent Document 1: JP 2002-28705 A1

Patent Document 2: JP 2000-24706 A1

DISCLOSURE OF INVENTION

However, when a non-water resistant lubricant is used according to the invention disclosed in Patent Document 1, cooling water which is sprayed on the rolls in a mandrel mill causes the lubricant applied to the surface of the mandrel bar to flows off. Therefore, there is the possibility of galling of the mandrel bar and the hollow shell occurring at the time of elongation rolling. In order to prevent this, Patent Document 1 discloses strictly controlling the supply and stop of cooling water to the rolls. However, it is impossible to completely eliminate dripping of cooling water which is sprayed up to immediately before the start of elongation rolling and water droplets which drop from the rolls. Accordingly, there is the possibility of galling of the mandrel bar and the hollow shell at the time of elongation rolling even with the invention disclosed in Patent Document 1 as well, and stable operation cannot be guaranteed.

Even if an unused mandrel bar is employed in a manner as disclosed in Patent Document 2, it is difficult to actually wash a conveyor so that the amount of graphite deposited on the surface of the mandrel bar becomes at most 100 $mg/m^2$ immediately after using a graphite-based lubricant. Accordingly, the possibility of galling of the mandrel bar and the hollow shell at the time of elongation rolling also exists with the invention disclosed in Patent Document 2, and stable operation cannot be guaranteed.

Accordingly, even in accordance with the inventions disclosed in Patent Documents 1 and 2, it is difficult in a manufacturing process using a mandrel bar to effectively suppress carburization which occurs particularly on a seamless tube made from a low carbon stainless steel.

The present invention is a method of manufacturing a seamless tube characterized by comprising a step of washing at least a portion of a conveyor installed in a conveying step of a mandrel bar which is situated from a lubricant applying device to the entrance of a mandrel mill, a step of washing, on the upstream side of the lubricant applying device, a mandrel bar which was used in elongation rolling, and a step of applying a lubricant and particularly a non-graphite-based lubricant to the mandrel bar with the lubricant applying device, wherein washing of the conveyor and the mandrel bar is performed such that the amount of graphite C2 ($g/m^2$) deposited on the surface of the mandrel bar before it is supplied to elongation rolling and the amount of carbon C1 ($g/m^2$) contained in an organic binder of the applied lubricant satisfy the following Equation 1 and Equation 2:

$$0.08\times C1+0.05\times C2\leqq 3 \quad (1), \text{ and}$$

$$3\leqq C1+C2\leqq 50 \quad (2).$$

The present invention is also a method of manufacturing a seamless tube comprising cyclic use of a mandrel bar by repeating the steps of washing at least a portion of a conveyor installed in a conveying step of a mandrel bar which is situated from a lubricant applying device to the entrance of a mandrel mill, applying a lubricant and particularly a non-graphite-based lubricant to a mandrel bar transported by the conveyor using the lubricant applying device, using the mandrel bar in elongation rolling of a hollow shell, and washing the mandrel bar, which was used in elongation rolling, on the upstream side of the lubricant applying device, characterized in that washing of the conveyor and the mandrel bar is performed such that the amount of graphite C2 ($g/m^2$) deposited on the surface of the mandrel bar before it is supplied to elongation rolling and the amount of carbon C1 ($g/m^2$) contained in an organic binder of the applied lubricant satisfy the above-described Equations 1 and 2.

In these methods of manufacturing a seamless tube according to the present invention, washing of a conveyor and a mandrel bar is preferably carried out by spraying the conveyor and the mandrel bar with high pressure water at a pressure of 30-150 MPa.

In these methods of manufacturing a seamless tube according to the present invention, washing of the conveyor may also be preferably carried out by bringing a rotating buff into contact with at least the portions of the conveyor which are to be contacted with the mandrel bar.

From another standpoint, the present invention is cleaning equipment characterized by comprising a first washing means which washes a conveyor disposed in the region from a lubricant applying device and particularly a non-graphite-based lubricant applying device installed in a conveying step of a mandrel bar to the entrance of a mandrel mill, and a second washing means which sprays, on the upstream side of the lubricant applying device, high pressure water at a water pressure of 30-150 MPa on the outer surface of a mandrel bar which was supplied to elongation rolling to wash the mandrel bar. The above-described methods of manufacturing a seamless tube according to the present invention can be carried out using this cleaning equipment.

Preferably the cleaning equipment according to the present invention further comprises a wiping means comprising a buff, a rotational drive mechanism which rotates the buff, and a moving mechanism which moves the buff between a position in which it does not interfere with a mandrel bar being transported by the conveyor and a position in which it contacts a portion of the conveyor for the mandrel bar which contacts the mandrel bar.

In the present invention, an example of the seamless tube to be manufactured is a seamless tube made of a low carbon stainless steel which has suffered a problem with carburization of the inner surface of the tube during elongation rolling.

With the manufacturing methods and cleaning equipment for a seamless tube according to the present invention, the problem of carburization of the inner surface of a tube experienced when a seamless tube made of a low carbon stainless steel is manufactured in manufacturing facilities designed primarily for common steel tubes in which a graphite-based lubricant is also used can be solved, and the occurrence of galling can be suppressed during elongation rolling even if a non-graphite-based lubricant is used.

Therefore, according to the present invention, occurrence of carburization on the inner surface of a tube during elongation rolling can be effectively suppressed without impeding rolling operations.

LIST OF REFERENCE NUMERALS

Figure 1:
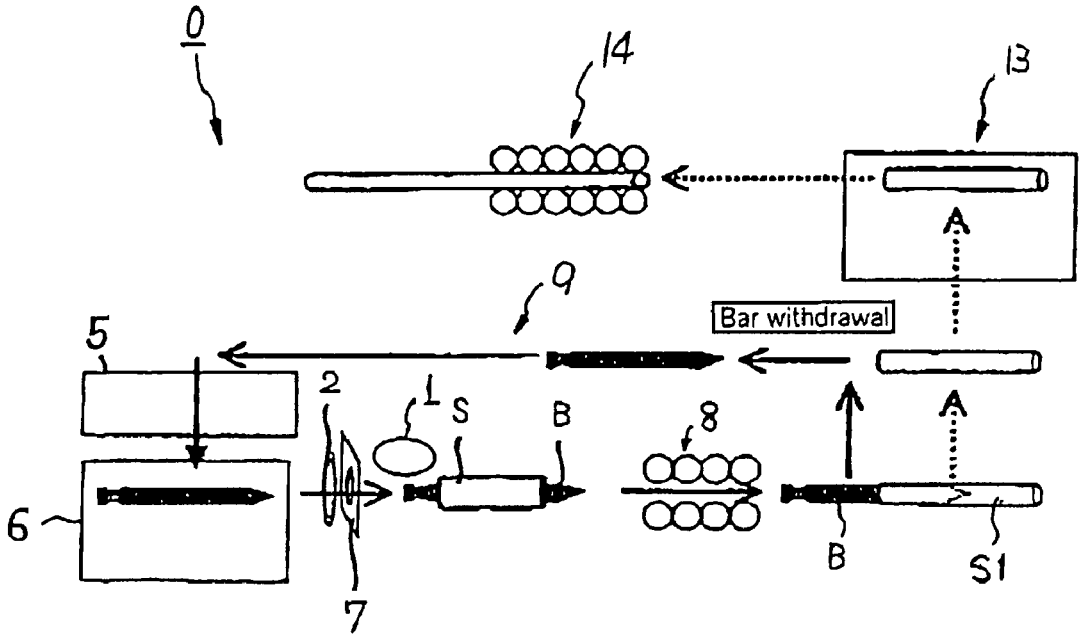
FIG. 1 is an explanatory view schematically showing a manufacturing process for a seamless tube.

0: manufacturing process; 1*a*, 1*b*, 1*c*: washing nozzles; 2: washing device; 3: wiping means; 31: buff; 32: rotational drive mechanism; 33: moving mechanism; 4: rotating brush; 5: water cooling apparatus; 6: feed table; 7: lubricant applying device; 8: mandrel mill; 9: return line; 10 transport roll; 11, 12: high pressure water; 13: reheating furnace; 14: stretch reducer; 15: washing device; 16: brushing apparatus; 17: transport roll; 18: skew roll; 19: high pressure water

BEST MODE FOR CARRYING OUT THE INVENTION

The best mode for carrying out the present invention will be explained in detail while referring to the accompanying drawings. In the following explanation, an example will be given of the case in which a lubricant is a non-graphite-based lubricant and a seamless tube made of a low carbon stainless steel is manufactured.

First, the principles of the present invention will be explained.

A non-graphite-based lubricant contains an organic binder which is added in the minimum necessary amount in order to provide the binder with adherability and storage stability. This organic binder contains carbon. Therefore, even if it is assumed that graphite which adhered to a mandrel bar or a conveyor for a mandrel bar when a graphite-based lubricant was applied to the mandrel bar is completely washed off and removed, the carbon contained in the organic binder can still be a cause of carburization. The extent to which carbon contained in an organic binder and graphite contained in a lubricant can adhere to a conveyor without the inner surface of the tube undergoing carburization will be explained below.

Carbon contained in an organic binder and graphite both function in the same manner as a source of carbon causing carburization of the inner surface of a tube, but they differ with respect to the extent of their effect on carburization.

Table 1 shows the results of measurement of the amount of carbon C ($g/m^2$) deposited on the inner surface of a tube immediately after rolling, the tube being produced by subjecting a hollow shell only to elongation rolling without subsequent heat treatment using four types of mandrel bars for which the amount of carbon C1 ($g/m^2$) contained in an organic binder of a non-graphite-based lubricant and the amount of graphite C2 ($g/m^2$) deposited on the surface were varied by varying the compositions of lubricants applied thereto. In Table 1, the amount of carbon C ($g/m^2$) deposited on the inner surface of a tube was determined by scraping off a region of predetermined area (measured area) from the inner surface of the tube, measuring the carbon content of the powder which was scraped off using the quantvac method (a kind of emission spectral analysis), and calculating the value of the measured amount of carbon (mass)/measured area.

TABLE 1

| | C1 | C2 | C |
|---|---|---|---|
| Condition 1 | 9.6 | 2.5 | 0.01 |
| Condition 2 | 9.6 | 31.6 | 0.026 |
| Condition 3 | 15.96 | 50.2 | 0.036 |
| Condition 4 | 20.2 | 62.6 | 0.047 |

From the results shown in Table 1, the relationship expressed by Equation 3:

$$C=0.0008\times C1+0.0005\times C2 \quad (3)$$

is established between C, C1, and C2.

In addition, as described below, it is preferable to suppress the increase in the carbon concentration to at most 0.01%. To this end, the amount of carbon C deposited on the inner surface of a tube which is given by Equation 3 is suppressed to at most 0.03 $g/m^2$, from which the following relationship is derived:

$$0.08\times C1+0.05\times C2\leqq 3 \quad (1).$$

FIG. 1 is an explanatory view schematically showing a manufacturing process for a seamless tube. Referring to FIG. 1, a conveying step in which a mandrel bar B should be washed in order to effectively suppress contamination by graphite on its surface while it is being transported for use in elongation rolling will be explained below.

As shown in FIG. 1, in this manufacturing process 0, a mandrel bar B which is was used in previous elongation rolling operation and transported back is cooled by a water cooling apparatus 5 and placed on a feed table 6. Next, a graphite-based lubricant is applied to the mandrel bar B by a lubricant applying device 7. The mandrel bar B is then inserted into a hollow shell S which was formed by piercing by a piercer (not shown), and the hollow shell S is subjected to elongation rolling by a mandrel mill 8 under usual operating conditions to form a tube S1. The mandrel bar B is then withdrawn from the tube S1 and returned to the water cooling apparatus 5 along a return line 9. The mandrel bar B is thus used repeatedly for elongation rolling by the above-described manner. As a result of this cyclic use of the mandrel bar B, a conveyor (not shown) for transporting the mandrel bar B is contaminated by the organic binder contained in the non-graphite-based lubricant and graphite previously adhering to the conveyor.

Portions of the conveyor situated in the regions indicated by the following conditions 1-4 are then washed.

| | |
|---|---|
| Condition 1: | From the lubricant applying device 7 1 to the entrance of the mandrel mill 8 in FIG. 1; |
| Condition 2: | From the exit of the mandrel mill 8 to the water cooling apparatus 5 in FIG. 1; |
| Condition 3: | Both from the lubricant applying device 7 to the entrance of the mandrel mill 8 and from the exit of the mandrel mill 8 to the water cooling apparatus 5 in FIG. 1; and |
| Condition 4: | No washing |

After washing the portions of the conveyor situated in the regions shown by conditions 1-4, a new mandrel bar B which was coated with a non-graphite-based lubricant with a coating weight of 5 $g/m^2$ carbon using the lubricant applying device 7 was only transported by the conveyor (a step referred herein to as circulation), and the amount of carbon deposited on the surface of each mandrel bar B was measured. The mandrel bar B which completed this circulation was then actually used for elongation rolling of a hollow shell S, and the state of carburization on the inner surface of the tube S1 obtained by elongation rolling was measured.

The results of measurement are shown in Table 2. The units of the numerical is values shown in Table 2 are all $g/m^2$. The state of carburization was evaluated as double circle (◎) when the carbon concentration of the inner surface was the same or less than that of the hollow shell prior to elongation rolling (no carburization), as circle (○) when the increase in the carbon concentration was within a permissible range of 0.001-0.01%, and as X when the increase in the carbon concentration was above this amount. The carbon concentration was measured by cutting a sample for analysis from the inner surface of the tube after elongation rolling and measuring the amount of carbon by the quantvac method (emission spectral analysis).

TABLE 2

| | Amount of deposited carbon after lubricant application (A) | Amount of deposited carbon after circulation (B) | Amount of carbon contamination (B − A) | State of carburization |
|---|---|---|---|---|
| Condition 1 | 5 | 28 | 23 | ○ |
| Condition 2 | 5 | 51 | 46 | X |
| Condition 3 | 5 | 11 | 6 | ◎ |
| Condition 4 | 5 | 76 | 71 | X |

As shown for Conditions 1 and 3 in Table 2, carburization can be satisfactorily suppressed by washing the conveyor at least in the region from the lubricant applying device 7 to the entrance of the mandrel mill 8. In addition, as shown for Conditions 2 and 4 in Table 2, when the amount of carbon deposited on the surface of the mandrel bar B after completion of circulation, namely, on the surface of the mandrel bar B just before it is supplied to elongation rolling is larger than 50 g/m$^2$, significant carburization develops on the inner surface of the tube S1.

If the amount of deposited carbon {the sum of the amount of deposited carbon remaining after washing, the amount of deposited carbon from the conveyor for the mandrel B, and the amount of carbon contained in the applied lubricant (the amount of carbon in the organic binder or the amount of graphite)} on the surface of the mandrel bar B which is supplied to elongation rolling is suppressed to at most 50 g/m$^2$, carburization of the inner surface of the tube S1 can be suppressed. However, if the amount of deposited carbon is less than 3 g/m$^2$, galling occurs at the time of elongation rolling, and as the standpoint of prevention of galling, the amount of deposited carbon is preferably at least 3 g/m$^2$.

Furthermore, the following facts (A) and (B) were found from analysis of the deposit on the surface of the mandrel bar B.

(A) When a graphite-based lubricant is applied to the surface of a mandrel bar B and the mandrel bar B is used for usual elongation rolling, if the mandrel bar B is analyzed for the surface deposit in an as-used state, namely, if the mandrel bar B is extracted and analyzed immediately after use in elongation rolling without being transported by a mandrel bar conveyor, around 50-100 g/m$^2$ of carbon is often deposited on the mandrel bar.

(B) If a used mandrel bar B is previously washed offline and then analyzed for the surface deposit, namely, if a mandrel bar B is extracted immediately after use in elongation rolling without being transported by a mandrel bar conveyor and is then washed offline and analyzed, the amount of deposited carbon on the surface of the mandrel bar B is suppressed to at most 5 g/m$^2$.

From these facts (A) and (B) and from the fact that carburization develops if the amount of deposited carbon exceeds 50 g/m$^2$ (see Table 2), it is preferable to wash the mandrel bar B immediately before supplying it to elongation rolling, i.e., prior to the lubricant applying device 7 which applies a non-graphite-based lubricant.

As the number of times that a mandrel bar B is supplied to elongation rolling increases, there is the possibility that the amount of carbon adhering to the surface of the mandrel bar B will increase, so the mandrel bar B is preferably washed each time it is supplied to elongation rolling.

The present invention was completed based on these facts. Referring to FIG. 1, it is a method of manufacturing a seamless tube characterized by comprising a step of washing at least a portion of a conveyor installed in a conveying step of a mandrel bar B which is situated from a lubricant applying device 7 to the entrance of a mandrel mill 8, a step of washing, on the upstream side of the lubricant applying device 7, a mandrel bar B which was used in elongation rolling, and a step of applying a lubricant and particularly a non-graphite-based lubricant to the mandrel bar B with the lubricant applying device 7, wherein washing of the conveyor and the mandrel bar B is performed such that the amount of graphite C2 (g/m$^2$) deposited on the surface of the mandrel bar B before being supplied to elongation rolling and the amount of carbon C1 (g/m$^2$) contained in an organic binder of the applied lubricant satisfy the following Equation 1 and Equation 2:

$$0.08\times C1+0.05\times C2\leqq 3, \text{ and} \qquad \text{Equation 1}$$

$$3\leqq C1+C2\leqq 50 \qquad \text{Equation 2}$$

According to the present invention, as described above, a seamless tube can be effectively prevented from carburization, and as described below, a conveyor for a mandrel bar B can be washed without interfering with the rolling operation.

Next, the washing conditions for washing a mandrel bar B and a conveyor so as to satisfy above-described Equation 1 and Equation 2 will be explained.

Two transport roll washing devices 1 equipped with test washing nozzles for spraying high pressure water at a conveyor for a mandrel bar B in the form of transport rolls are provided for each transport roll. A graphite-based lubricant is applied to a mandrel bar B, and the mandrel bar B is used for elongation rolling of a hollow shell S under usual conditions, thereby adequately contaminating the conveyor (transport rolls) for the mandrel bar B by graphite and an organic binder. Thereafter the surface of the transport rolls is washed by spraying high pressure water from the washing nozzles while the transport rolls are rotated.

When it is found by visual observation that the entire surface of each transport roll recovers a metallic luster, it is determined that contamination by graphite and the organic binder has been eliminated and washing is terminated. This test is evaluated by estimating the washing time from the start to the completion of washing. The washing time estimated for one transport roll is made the time necessary to wash the entire conveyor in the region from the lubricant applying device 7 to the entrance of the mandrel mill 8.

The above-described test was repeated while gradually varying the water pressure of high pressure water sprayed from the washing nozzles. If the number of washing nozzles which are installed is increased to three or more, the time necessary for washing of the transport area of the mandrel bar B of course be decreased by the amount of the increase in the number of nozzles.

Next, a test for determining the optimal washing conditions for washing the surface of a mandrel bar B will be explained.

Eight washing nozzles are disposed in a circle upstream of the lubricant applying device 7. A mandrel bar B which was adequately contaminated by being coated with a graphite-based lubricant and subjected to usual elongation rolling is washed while being transported at a usual transport speed. The deposit on the surface of the mandrel bar B after washing was analyzed to determine the amount of carbon (g/m$^2$) deposited on the surface of the mandrel bar B.

In addition, the pressure of high pressure water sprayed from the washing nozzles is varied. As is usual, an oxide film formed with the object of preventing galling is present on the surface of the mandrel bar B used in this test. It is ascertained by microscopic observation of the surface that peeling of the oxide film does not occur due to this washing.

The results of washing the surface of the mandrel bar B and the surface of the conveyor therefor in the above-described washing tests are shown in Table 3.

TABLE 3

| Pressure of high pressure water (MPa) | Transport line Washing time (minutes) | Mandrel bar Amount of deposited carbon (g/m$^2$) | Mandrel bar Condition of oxide film | Overall evaluation |
|---|---|---|---|---|
| 20 | — | 58 | good | X |
| 30 | 25 | 43 | good | ○ |
| 40 | 18 | 37 | good | ◎ |
| 60 | 15 | 20 | good | ◎ |
| 80 | 15 | 16 | good | ◎ |
| 100 | 15 | 11 | good | ◎ |
| 120 | 12 | 8 | good | ◎ |

TABLE 3-continued

| Pressure of high pressure water (MPa) | Transport line Washing time (minutes) | Mandrel bar Amount of deposited carbon ($g/m^2$) | Mandrel bar Condition of oxide film | Overall evaluation |
|---|---|---|---|---|
| 150 | 12 | 5 | partial peeling | ○ |
| 160 | — | 1 | peeling | X |

As shown in Table 3, the conveyor for the mandrel bar B can be washed in a washing time which does not interfere with operations by spraying high pressure water at a water pressure of at least 30 MPa and preferably at least 40 MPa.

As described above, the results shown in Table 3 are for the case in which two washing nozzles are provided for each transport roll. The results show the estimated time necessary for washing the entire conveyor installed in the region from the lubricant applying device 7 to the entrance of the mandrel mill 8. Therefore, when the are, for example, four washing nozzles installed for each transport roll, the washing time is halved in accordance with the increase in the number of washing nozzles.

Regarding washing of the mandrel bar B, the amount of carbon deposited on the surface of the mandrel bar can be made at most 50 $g/m^2$ by spraying high pressure water at a water pressure of at least 30 MPa to wash the surface. Namely, a predetermined amount of a non-graphite-based lubricant is applied to the mandrel bar B by the lubricant applying device 7 after the bar has been washed, and the amount of deposited carbon on the surface of the mandrel bar B after being transported by the entire conveyor between the lubricant applying device 7 and the entrance of the mandrel mill 8 is made at most 50 $g/m^2$, whereby above-described Equation 2 can be satisfied. However, if high pressure water with a water pressure of higher than 150 MPa is sprayed, the oxide film formed on the surface of the mandrel bar B will peel off, resulting in the occurrence of rolling defects such as galling.

Although not shown in Table 3, the relationship expressed by Equation 1 is satisfied if high pressure water at a water pressure of at least 30 MPa is sprayed. To this end, in the same manner as described above, the coating amount (coating thickness) of lubricant on the surface of the mandrel bar B after washing, application of lubricant, and transport was measured, and based on the measured value and the previously known composition of the lubricant, the amount of carbon C 1 contained in the organic binder and the amount of graphite C2 were calculated.

For the above-described reasons, the water pressure of high pressure water for washing the surface of the mandrel bar B and its conveyor is preferably set to 30-150 MPa. Accordingly, in the step of washing at least a portion of a conveyor installed in a conveying step of a mandrel bar B which is situated from a lubricant applying device 7 to the entrance of a mandrel mill 8 and in the step of washing, on the upstream side of the lubricant applying device 7, the mandrel bar B which was supplied to elongation rolling, washing is preferably carried out by spraying with high pressure water at a water pressure of 30-150 MPa.

In general, transport rolls are frequently used as a conveyor for a mandrel bar B. However, a conveyor such as a chain conveyor which has conveyor elements which are exposed to the exterior and contact a mandrel bar is sometimes used together with transport rolls. Such conveyor elements of a conveyor are also contaminated by graphite and the like as a mandrel bar B is being transported thereby. If these conveyor elements are washed by spraying the above-described high pressure water, in the case of a chain conveyor, for example, lubricant which was applied to the conveyor with the object of lubricating the chain is washed off together with graphite and the like and wear of the chain progresses, whereby the service life of the chain markedly decreases and in the worst case, its failure results. Therefore, it is preferable not to carry out the above-described washing by spraying high pressure water with respect to a conveyor having conveyor elements contacting a mandrel bar B which are exposed to the exterior.

Accordingly, with respect to a conveyor such as a chain conveyor for which it is undesirable to carry out washing by spraying of high pressure water, washing is preferably carried out by wiping the surface of the conveyor which contacts a mandrel bar B using a wiping device having a rotating buff which is brought into contact with the surface for cleaning the surface by wiping.

By this method, graphite and the like deposited on the surfaces in a chain conveyor, for example, which contact a mandrel bar B can be wiped off by the rotating buff, and a conveyor such as a chain conveyor can be cleaned without producing a decrease in the service life of the conveyor caused by spraying high pressure water.

This wiping device preferably comprises a buff, a rotational drive mechanism which rotates the buff, and a moving mechanism which moves the buff between a position in which it does not interfere with a mandrel bar which is being transported and a position in which it contacts a portion of a conveyor for the mandrel bar which contacts the mandrel bar.

With this arrangement designed for a conveyor system for a mandrel bar B which incorporates a conveyor such as a conveyor using a chain, which cannot be washed by spraying high pressure water, when transporting a mandrel bar B by the conveyor, the buff is moved by the moving mechanism to a position in which it does not interfere with the mandrel bar. When performing cleaning when a mandrel bar B is not being transported, the buff is moved by the moving mechanism to a position where it contacts the surface of a portion of the conveyor which contacts a mandrel bar B, and the buff is rotated by the rotational drive mechanism. In this manner, graphite and the like deposited on the contact surface of the conveyor can be wiped off without bringing about a decrease in the service life of the conveyor.

Next, the best mode for carrying out the present invention will be explained.

In this embodiment, as shown in FIG. 1 at least a portion of a conveyor installed in a conveying step of a mandrel bar B which is situated from a lubricant applying device 7 to the entrance of a mandrel mill 8 is washed. In addition, a mandrel bar B which has been used for previous elongation rolling is washed on the upstream side of the lubricant applying device 7. Furthermore, a lubricant and particularly a non-graphite-based lubricant is applied to the mandrel bar B by the lubricant applying device 7.

At this time, the conveyor and the mandrel bar B are washed so that the amount of graphite C2 ($g/m^2$) deposited on the surface of the mandrel bar B before it is supplied to elongation rolling and the amount of carbon C1 ($g/m^2$) contained in an organic binder of the applied lubricant satisfy:

Equation 1: $0.08 \times C1 + 0.05 \times C2 \leqq 3$ and Equation 2: $3 \leqq C1 + C2 \leqq 50$, in the manufacture of a seamless tube.

Figure 2:
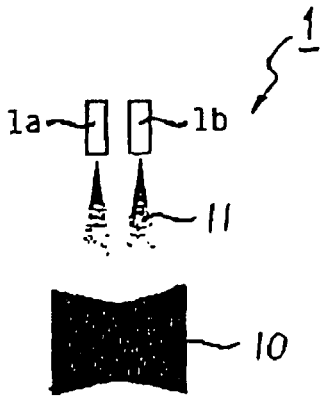
FIG. 2 is an explanatory view showing a first washing means (washing device) of cleaning equipment used for cleaning a conveyor in the form of transport rolls.

FIG. 2 is an explanatory view showing a washing device 1 in the form of a first washing means of cleaning equipment used for cleaning a conveyor in the form of transport rolls.

In this example, the case is shown in which a conveyor comprises transport rolls. As shown in FIG. 2, two washing nozzles 1*a* and 1*b* are disposed in positions several hundred millimeters above the surface of each transport roll 10, and the transport roll 10 is washed by spraying high pressure water 11 from the washing nozzles 1*a* and 1*b* toward the transport roll 10 while the transport roll 10 is rotated.

Figure 3:
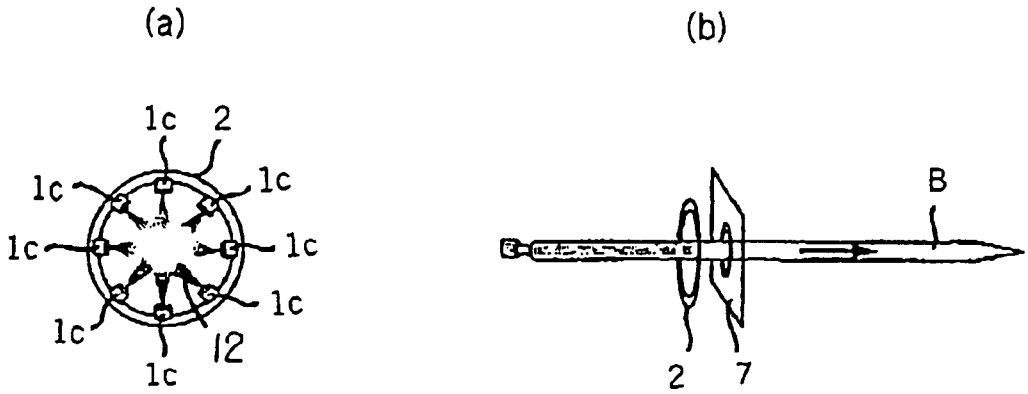
FIGS. 3(*a*) and 3(*b*) are explanatory views showing the structure of a second washing means (washing device) of cleaning equipment used for cleaning the surface of a mandrel bar, FIG. 3(*a*) being a front view of the second washing device and FIG. 3(*b*) being an explanatory view showing the arrangement of the second washing device.

FIG. 3 gives explanatory views showing the structure of a washing device 2 which is a second washing means of cleaning equipment used for cleaning the surface of a mandrel bar B, in which FIG. 3(*a*) is a front view of the second washing device 2 and FIG. 3(*b*) is an explanatory view showing the arrangement of the second washing device 2.

As shown in FIG. 3, a mandrel bar B which has been used for elongation rolling of a hollow shell is washed by the second washing device 2 disposed on the upstream side of the lubricant applying device 7 shown in FIG. 1. The second washing device 2 comprises eight washing nozzles 1*c* disposed upstream of the lubricant applying device 7 along a ring with a maximum separation from the mandrel bar B of several hundred millimeters. The surface of the mandrel bar B is washed by spraying high pressure water 12 from each of the washing nozzles 1*c* towards the mandrel bar B which has completed elongation rolling.

The tube S1 which underwent elongation rolling in the mandrel mill 8 is reheated for approximately 20-35 minutes at approximately 940° C.-1060° C. in the reheating furnace 13, and then it is finished to final dimensions in a stretch reducer 14 to manufacture a seamless tube.

Table 4 shows the results of evaluation of the state of carburization on the inner surface of a seamless tube made of a low carbon stainless steel manufactured by the manufacturing method according to the above-described embodiment and the state of carburization on the inner surface of a seamless tube made of a low carbon stainless steel manufactured by a comparative example of a manufacturing method.

In the evaluation of the state of carburization, a sample for analysis was cut from the inner surface of the seamless tube after the first, fifth, and tenth rolling passes, and the carbon concentration of each sample was measured by the quantvac method (emission spectral analysis). The case in which the carbon concentration was the same or lower than that of the material forming the tube was evaluated as ◎ (no carburization), the case in which the carbon concentration increased by 0.001-0.01% was evaluated as ○ (permissible range), and the case in which there was a greater increase in the carbon concentration was evaluated as X.

TABLE 4

| | Mandrel bar | From lubricant applying device to entrance of mandrel mill | From exit of mandrel mill to water cooling shower | State of carburization 1st pass | 5th pass | 10th pass | Comments |
|---|---|---|---|---|---|---|---|
| Condition 1 | Washing | Washing | No washing | ○ | ○ | ○ | This invention |
| Condition 2 | Washing | No washing | Washing | X | X | X | Comparative |
| Condition 3 | Washing | Washing | Washing | ◎ | ◎ | ◎ | This invention |
| Condition 4 | Washing | No washing | No washing | X | X | X | Comparative |
| Condition 5 | No washing | Washing | No washing | X | X | X | Comparative |
| Condition 6 | No washing | No washing | Washing | X | X | X | Comparative |
| Condition 7 | No washing | Washing | washing | X | X | X | Comparative |
| Condition 8 | No washing | No washing | No washing | X | X | X | Comparative |

In this embodiment, the water pressure of high pressure water 12 sprayed from each of the washing nozzles 1*a*-1*c* is set at 100 MPa. In addition, the angle of spreading of high pressure water which is sprayed is set at 10-20 degrees. As a result, washing of the mandrel bar B can be completed with a washing time of around 15 minutes (see Table 3).

When manufacturing a seamless tube, first, using the above-described first washing device 1 having washing nozzles 1*a* and 1*b*, each of the transport rolls disposed in the conveying step of the mandrel bar B is washed. Next, the mandrel bar B is introduced to the conveying step from the feed table 6 shown in FIG. 1. Subsequently, after a non-graphite-based lubricant is applied to the surface of the mandrel bar B by the lubricant applying device 7, the mandrel bar B is inserted into a hollow shell S along the conveying step up to the entrance of the mandrel mill 8, and elongation rolling of the hollow shell is carried out in the mandrel mill 8. After the completion of elongation rolling in the mandrel mill 8, the mandrel bar B is withdrawn from the resulting tube S1, and it is transported along the return line 9 and cooled by the water cooling apparatus 5. Then, the mandrel bar B is washed by the second washing device 2, a non-graphite-based lubricant is again applied to the surface of the mandrel bar B by the lubricant applying device 7, and it is supplied to a second or higher pass of elongation rolling by a step which is the same as the above-described described step.

As shown in Table 4, in the seamless tubes manufactured by comparative examples of a manufacturing method, carburization developed. In contrast, in the seamless tubes manufactured by the manufacturing method of this embodiment, carburization in each of the first, fifth, and tenth passes was suppressed to a level which causes essentially no problems.

In this embodiment, a mode was explained in which a conveyor for a mandrel bar B is washed by spraying high pressure water from washing nozzles 1*a* and 1*b* towards each transport roll 10, but sometimes a conveying apparatus using chains, such as a chain conveyor, is installed as a conveyor for a mandrel bar B in addition to transport rolls. Such a conveyor is preferably cleaned using a wiping means employing a buff, instead of washing by spraying high pressure water, so as not to cause a decrease in service life of the chain.

Figure 4:
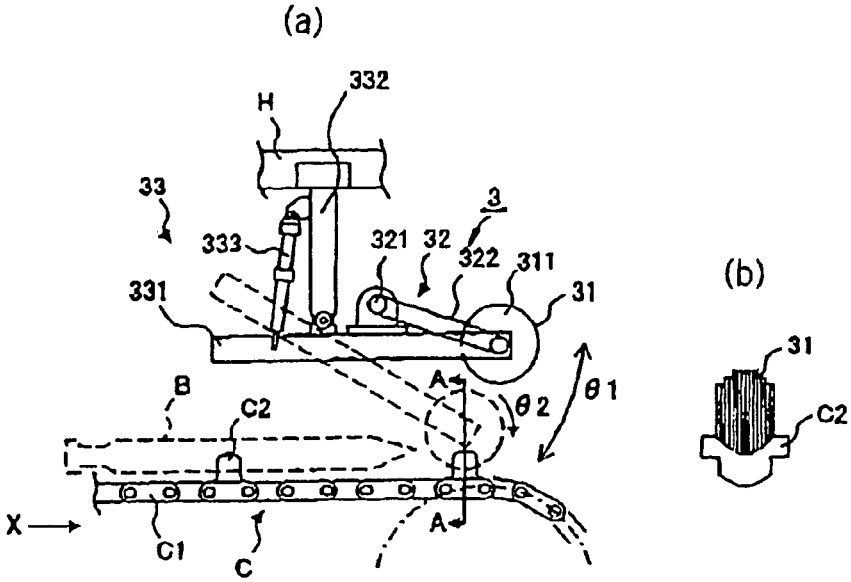
FIGS. 4(*a*) and 4(*b*) are explanatory views showing the structure of a wiping means, FIG. 4(*a*) being a side view of the wiping means and FIG. 4(*b*) being a cross-sectional view taken along line A-A of FIG. 4(*a*).

FIG. 4 gives explanatory views showing the structure of a wiping means 3, in which FIG. 4(*a*) is a side view of the wiping means 3 and FIG. 4(*b*) is a cross-sectional view taken along line A-A in FIG. 4(*a*).

As shown in FIG. 4, the wiping means 3 is intended to clean a chain conveyor C equipped with mandrel support portions C2 provided at a plurality of suitable locations on a chain C1 which is wound so as to form an endless path. A mandrel bar B is mounted atop the mandrel support portions C2 and is transported by movement of the chain C1 in the direction of arrow X.

The wiping apparatus 3 has a buff 31, a rotational drive mechanism 32 which rotates the buff 31, and a moving mechanism 33 which moves the buff 31 in the directions shown by arrow θ1 in the example shown in FIG. 4 between a position in which it does not interfere with the mandrel bar B while the bar is being transported by the chain conveyor C (the position shown by solid lines in FIG. 4) and a position in which it contacts the surfaces of the chain conveyor C which contact the mandrel bar B, namely, the top surfaces of the support portions C2 (the position shown by dashed lines in FIG. 4).

The buff 31 is constituted by a suitable material in the form of a fabric such as cotton, linen, wool, or the like, or other material such as a polyurethane, sponge, felt leather, or rubber wrapped around a drum 311 in the circumferential direction.

The rotational drive mechanism 32 is equipped with a motor 321 and a belt 322 wrapped around and extending between the shaft of the motor 321 and the shaft of the drum 311. The rotational drive force of the motor 321 is transmitted to the drum 311 through the belt 322 and rotates the buff 31.

The moving mechanism 33 is equipped with an arm 331 on which the buff 31 and the rotational drive mechanism 32 are installed, a support member 332 having one end thereof secured to a suitable beam H provided on the transport line and its other end rotatably supporting the arm 331, and a cylinder device 333 having one end thereof rotatably attached to the support member 332 and its other end rotatably attached to the arm 331. When the arm 331 is in the state shown by solid lines in FIG. 4, by retracting the piston rod of the cylinder device 333 and pulling upwards, the arm 331 is allowed to pivot about the other end portion of the support member 332 (it moves to the state shown by dashed lines in FIG. 4), and the buff 31 installed on the arm 331 moves to a position in which it contacts the upper surfaces of the support portions C2. Conversely, when the arm 331 is in the state shown by dashed lines in FIG. 4, by advancing the piston rod of the cylinder apparatus 333 and pressing downwards, the arm 331 pivots about the other end of the support member 332 (it moves to the state shown by solid lines in FIG. 4), and the buff 31 installed on the arm 331 is moved to a position in which it does not interfere with the mandrel bar B while the bar is being transported.

When the upper surfaces of the support portions C2 of the chain conveyor C is to be cleaned with a wiping means 3 having the above-described structure, the buff 31 is moved by the moving mechanism 33 to a position in which it contacts the support portions C2 of the chain conveyor C, and the buff 31 is rotated in the direction of arrow θ2 by the rotational drive mechanism 32 while the chain C is moved in the direction of arrow X without conveying a mandrel bar B, whereby graphite and the like deposited on the upper surface of each support portion C are successively wiped off.

Figure 5:
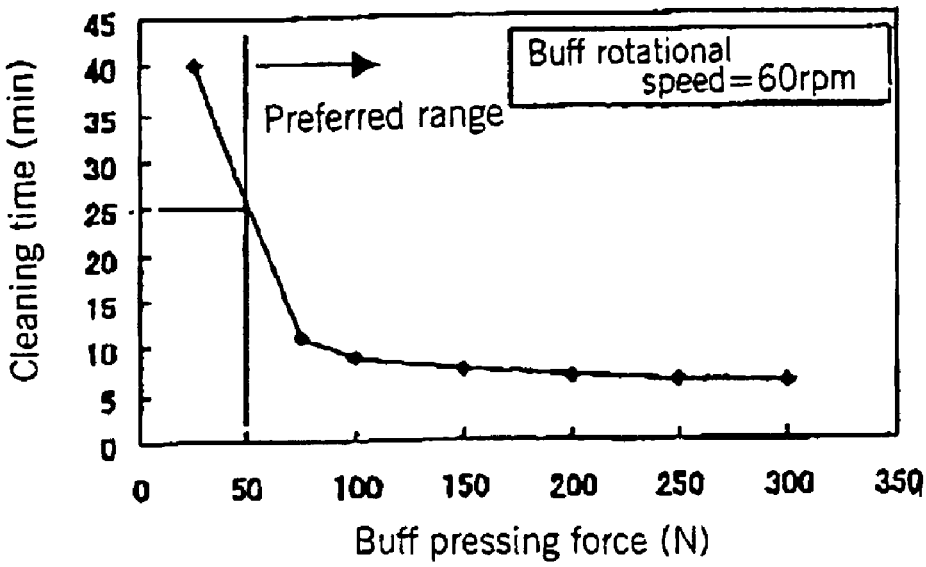
FIGS. 5(*a*) and 5(*b*) are graphs showing the results of tests for finding the optimal settings for the wiping apparatus, FIG. 5(*a*) showing the relationship between the pressing force of a buff against a support portion and the necessary cleaning time, and FIG. 5(*b*) showing the relationship between the rotational speed of the buff and the necessary cleaning time.
Figure 5:
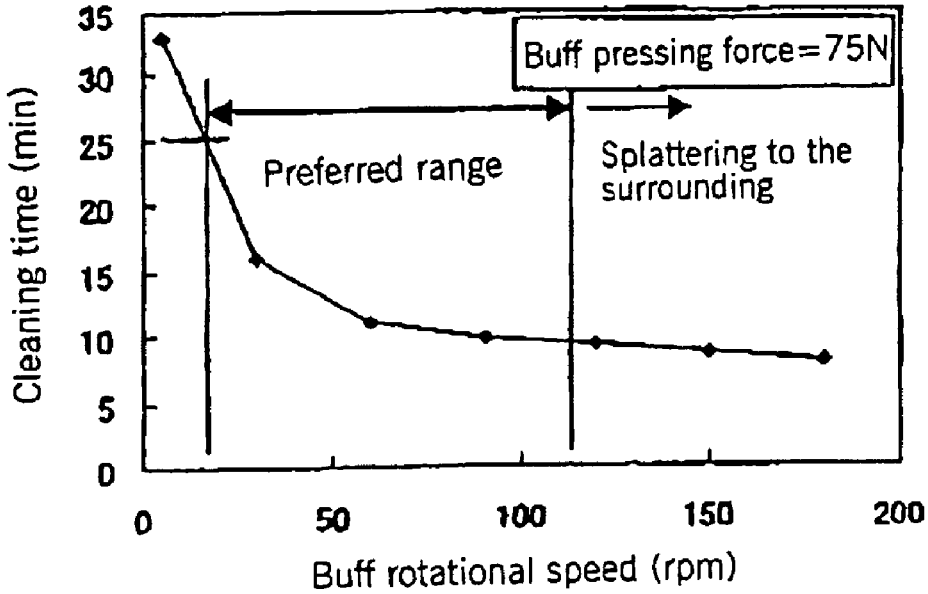

FIG. 5 gives graphs showing the results of a test carried out to determine the is optimal settings for the wiping means 3 in which FIG. 5(*a*) shows the relationship between the pressing force of the buff 31 against the support portions C2 and the necessary cleaning time, and FIG. 5(*b*) shows the relationship between the rotational speed of the buff 31 and the necessary cleaning time.

A hollow shell was rolled under usual operating conditions using a mandrel bar B to which graphite-based lubricant had been applied, thereby causing a chain conveyor C used to transport the bar to be adequately contaminated by graphite and an organic binder. Subsequently, the chain conveyor was cleaned using a new or cleaned buff 31 under various pressing forces or rotational speeds, and the cleaning time which was the time which elapsed from the start of cleaning to the completion of cleaning was determined.

After the start of cleaning, when the top surface of each support portion C2 was considered by visual observation to have completely recovered a metallic luster, it was determined that contamination by graphite and the organic binder had been removed, and cleaning was terminated.

As shown in FIG. 5(*a*), when the rotational speed of the buff 31 is maintained constant at 60 rpm and the pressing force against the support portions C2 is varied, the pressing force should be set to at least 50 N in order to obtain a cleaning time which does not interfere with operations, such as at most 25 minutes. As shown in FIG. 5(*b*), when the pressing force of the buff 31 against the support portions C2 is maintained constant at 75 N and the rotational speed of the buff 31 is varied, the rotational speed should be set to at least approximately 17 rpm in order to obtain a cleaning time which does not interfere with operations, such as at most 25 minutes. However, if the rotational speed is too fast, graphite and organic binder which are wiped from the support portions C2 by the buff 31 are splattered to the surrounding equipment, so the rotational speed is preferably set to at most approximately 110 rpm.

In the above description, an example was given of the case in which the surface of a mandrel bar B is washed by a so-called online washing device 2 positioned in a conveying step of a mandrel bar B in a manufacturing process of a seamless tube (referred to below as "online washing"). However, it is also possible to employ cleaning of the surface of the mandrel bar B before it is introduced to the conveying step (referred to below as "offline cleaning") together with this online washing. This offline cleaning will also be explained.

When a mandrel bar B which underwent application of a graphite-based lubricant and subsequent elongation rolling is removed from the conveying step and it is again introduced into the conveying step from the feed table 6, then coated with a non-graphite-based lubricant and subjected to elongation rolling, the surface of the mandrel bar B immediately after it is again introduced into the conveying step is contaminated by the graphite-based lubricant deposited thereon. Although the mandrel bar B immediately after being introduced into the conveying step is transported to the washing device 2 and washed therein, if the graphite-based lubricant adhering to the surface of the bar is not completely washed off and remains, carburization develops on the inner surface of the tube S1 formed by rolling. In order to prevent this, before the mandrel bar B is introduced into the conveying step, the surface of the mandrel bar B having a graphite-based lubricant deposited thereon is preferably previously cleaned by offline cleaning.

Figure 6:
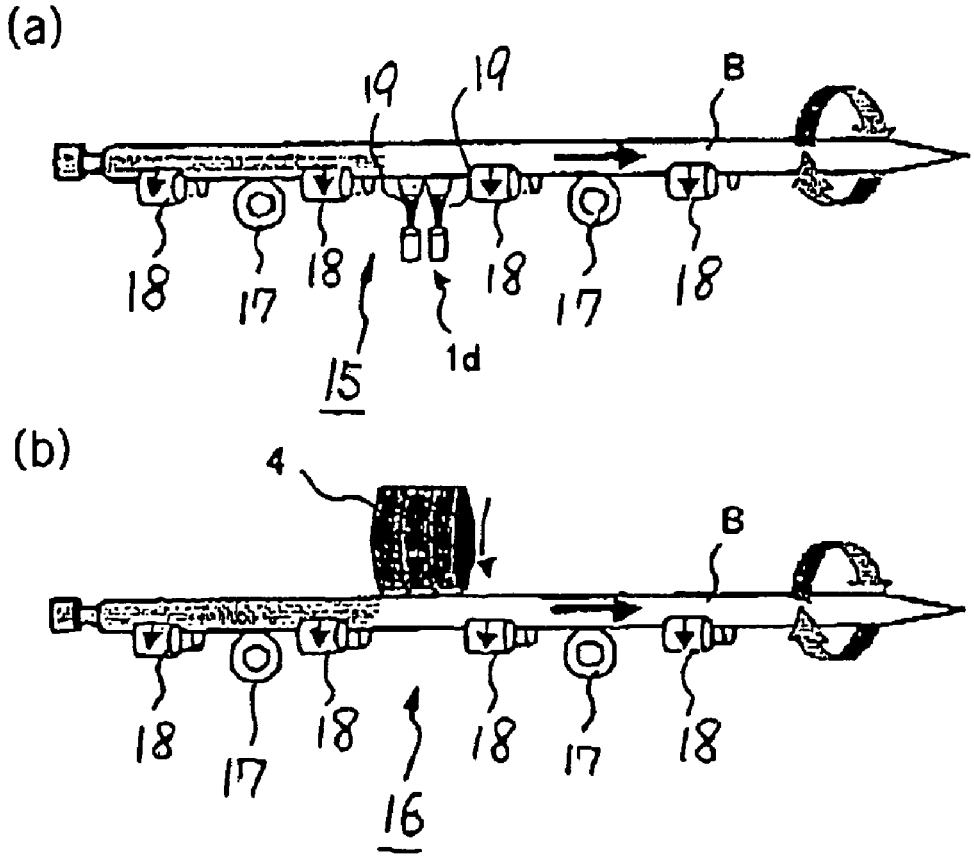
FIGS. 6(*a*) and 6(*b*) are explanatory views showing the structure of cleaning equipment used for offline cleaning of a mandrel bar, FIG. 6(*a*) showing a washing means by spraying the surface of a mandrel bar with high pressure water, and FIG. 6(*b*) showing a scraping means for contacting a rotating brush with the surface of a mandrel bar to clean it.

FIG. 6 gives explanatory views showing cleaning equipment 15, 16 used for offline cleaning of a mandrel bar B, in which FIG. 6(*a*) shows a washing device 15 for washing by spraying the surface of the mandrel bar with high pressure water and FIG. 6(*b*) shows a brushing apparatus 16 for cleaning by contacting the surface of the mandrel bar with a rotating brush.

The cleaning equipment 15, 16 shown in FIG. 6 can be disposed in a bar storage facility for storing mandrel bars B which is separated from a manufacturing line for seamless tubes.

The washing device 15 shown in FIG. 6(*a*) has transport rolls 17 and skew rolls 18 for supporting a mandrel bar B and two washing nozzles 1*b* disposed below it. By disposing the washing nozzles 1*d* below the mandrel bar, the distance between the washing nozzles 1*d* and the surface of the mandrel bar B can be maintained constant regardless of the outer diameter of the mandrel bar B. While high pressure water 19 is sprayed toward the mandrel bar B through the two washing nozzles 1*d*, the skew rolls 18 are rotated to rotate the mandrel bar B in the circumferential direction and the transport rolls 17 are rotated to transport the mandrel bar B in its axial direction. As a result, the entire surface of the mandrel bar B can be washed.

The brushing apparatus 16 shown in FIG. 6(*b*) has transport rolls 17 and skew rolls 18 for supporting a mandrel bar B and a rotating brush 4 which is disposed so as to contact the mandrel bar B. While the rotating brush 4 is rotated, the skew rolls 18 are rotated to rotate the mandrel bar B in the circumferential direction and the transport rolls 17 are rotated to transport the mandrel bar B in the axial direction. As a result, the entire surface of the mandrel bar B can be brushed by the rotating brush 4 and cleaned.

From the standpoint of efficiency, offline cleaning of the mandrel bar B is preferably carried out automatically using cleaning equipment as illustrated by FIG. 6, but an operator can manually clean the mandrel bar using a cleaning tool such as a scrub brush.

The invention claimed is:

1. A method of manufacturing a seamless tube comprising:

a) a step of applying a lubricant to a mandrel bar, b) a step of inserting the lubricated mandrel bar into a mother tube, c) a step of carrying out elongation rolling of the mother tube with a mandrel mill, d) a step of stripping a seamless pipe from the mandrel bar, e) a step of cooling the mandrel bar, and f) repeating steps (a-e) a number of times using the same mandrel bar characterized by comprising a step of washing at least a portion of a conveyor installed in a conveying step of the mandrel bar which is situated from a lubricant applying device to the entrance of a mandrel mill, a step of washing, on the upstream side of the lubricant applying device, the mandrel bar which is used for repeated elongation rolling, and a step of applying a lubricant to the mandrel bar by the lubricant applying device, wherein applying a non-graphite-lubricant organic binder-containing lubricant to the mandrel bar and washing of the conveyor and the mandrel bar are carried out such that the amount of graphite C2 ($g/m^2$) deposited on the surface of the mandrel bar before it is supplied to elongation rolling and the amount of carbon C1 ($g/m^2$) contained in an organic binder of the applied non-graphite-based organic binder-containing lubricant satisfies the following Equation 1 and Equation 2:

$$0.08 \times C1 + 0.05 \times C2 \leqq 3 \quad (1), \text{ and}$$

$$3 \leqq C1 + C2 \leqq 50 \quad (2).$$

2. A method of manufacturing a seamless tube as set forth in claim 1 wherein the conveyor is a roll conveyor and washing of the conveyor and the mandrel bar is carried out by spraying high pressure water at a water pressure of 30-150 MPa at the roll conveyor and the mandrel bar.

3. A method of manufacturing a seamless tube as set forth in claim 2 wherein washing of the roll conveyor is carried out by allowing a rotating buff to contact with at least the portions of the roll conveyor which is to be contacted with the mandrel bar.

4. A method of manufacturing a seamless tube as set forth in claim 1 wherein the conveyor is comprised of a chain conveyor, washing of the chain conveyor is carried out by allowing a rotating buff to contact with at least the portions of the chain conveyor which is to be contacted with the mandrel bar, washing of the mandrel bar is carried out by spraying high pressure water at a water pressure of 30-150 MPa at the mandrel bar.

* * * * *